United States Patent [19]

Weisenburger

[11] 4,377,321

[45] Mar. 22, 1983

[54] CARRIER MOUNTED TERMINALS

[75] Inventor: Lawrence P. Weisenburger, Kernersville, N.C.

[73] Assignee: AMP Incorporated, Harrisburg, Pa.

[21] Appl. No.: 207,582

[22] Filed: Nov. 17, 1980

[51] Int. Cl.[3] ..... H01R 9/14

[52] U.S. Cl. ..... 339/220 R; 339/17 C; 339/276 SF

[58] Field of Search ..... 339/17 C, 220, 221, 339/217, 276 SF

[56] References Cited

U.S. PATENT DOCUMENTS

| | | | |
|---|---|---|---|
| 2,820,211 | 1/1958 | Batcheller | 339/217 PS X |
| 2,958,926 | 11/1960 | Morison | 339/17 C X |
| 3,875,636 | 4/1975 | Shultz, Jr. et al. | 29/203 B |

*Primary Examiner*—Joseph H. McGlynn

[57] ABSTRACT

A metal strip is stamped and formed with electrical terminals and is doubled back on itself to provide mounting legs for the terminals.

3 Claims, 4 Drawing Figures

CARRIER MOUNTED TERMINALS

FIELD OF THE INVENTION

The present invention relates to mounting electrical terminals on a circuit board.

BACKGROUND OF THE PRIOR ART

Electrical terminals are stamped and formed from a metal strip, leaving portions of the strip interconnecting the terminals. Individual terminals are severed from the strip and mounted in a circuit board. Alternatively, as shown in U.S. Pat. No. 3,875,636, issued Apr. 8, 1975, several terminals while interconnected on a strip are first inserted into circuit board apertures and then the strip is removed.

SUMMARY OF THE INVENTION

The present invention utilizes an interconnecting metal strip to form mounting posts for those terminals interconnected along the strip. The strip is doubled back on itself to form resiliently compliant posts. Barbs are provided to lock the posts in circuit board apertures.

An object of the present invention is to provide plural electrical terminals with mounting posts formed from a metal strip which interconnects the terminals.

Another object of the present invention is to provide compliant mounting posts fabricated from a continuous carrier strip interconnecting plural electrical terminals.

Other objects and advantages of the present invention will become apparent from the following detailed description taken in conjunction with the drawings.

BRIEF DESCRIPTION OF THE DRAWINGS

FIG. 3 is a section along the line 3—3 of FIG. 2.

DETAILED DESCRIPTION

Figure 1:
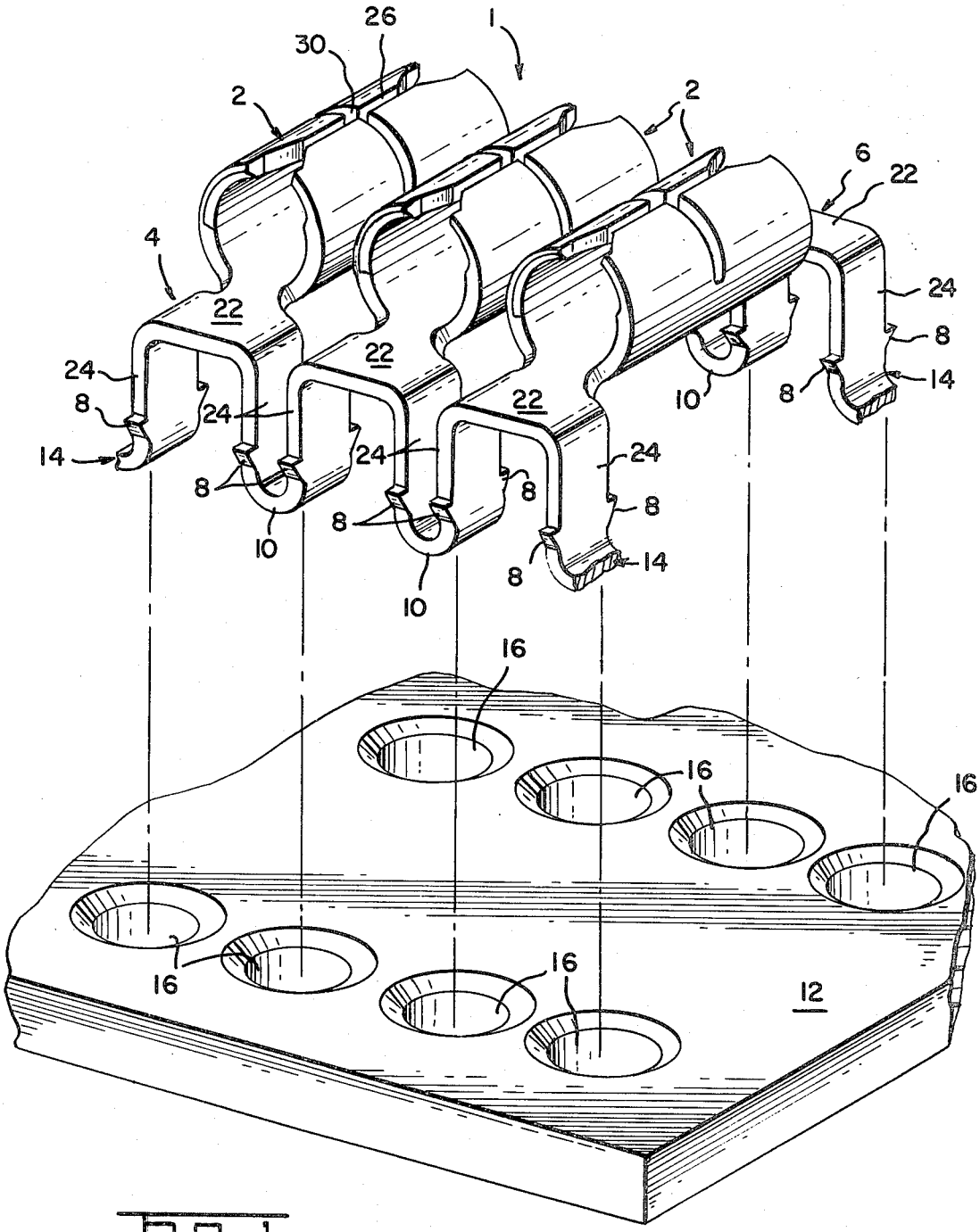
FIG. 1 is a fragmentary perspective view with parts exploded to illustrate a preferred embodiment.

With more particular reference to FIG. 1, a preferred embodiment of the present invention is shown generally at 1 and comprises plural, transversely slotted barrel terminals 2 of the type disclosed by U.S. Pat. No. 4,141,618, issued Feb. 27, 1979. According to this patent a barrel terminal is formed with a compliant sleeve portion which mounts into an aperture of a circuit board. Each sleeve portion adds to the material bulk and cost.

Figure 2:
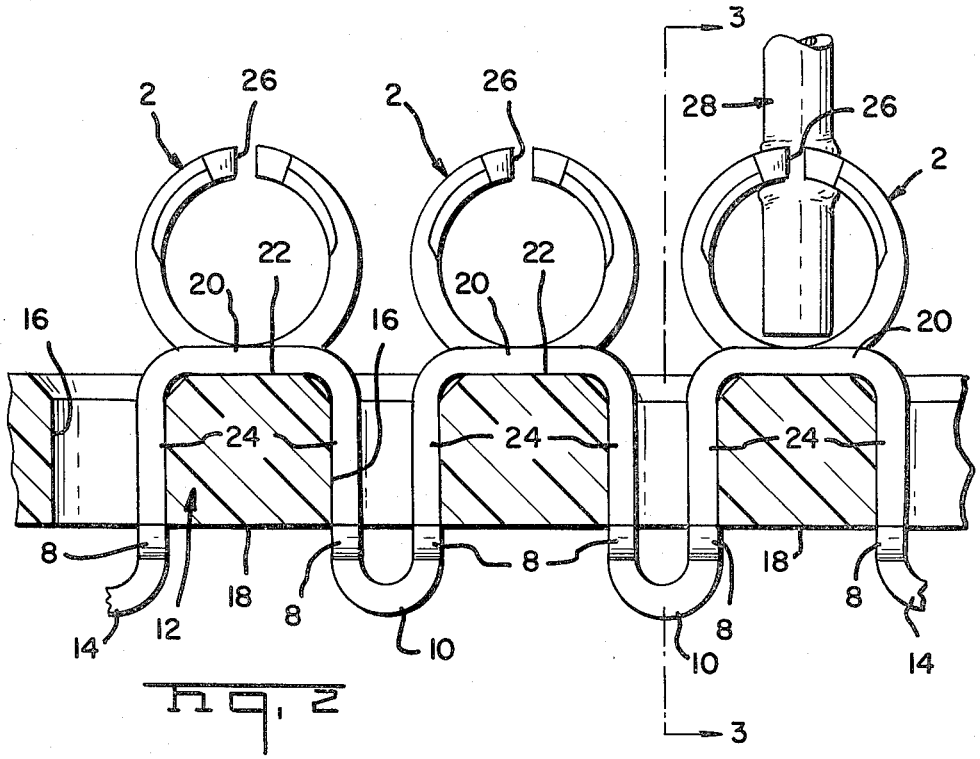
FIG. 2 is a fragmentary elevation in section of the assembled parts shown in FIG. 1.
Figure 7:
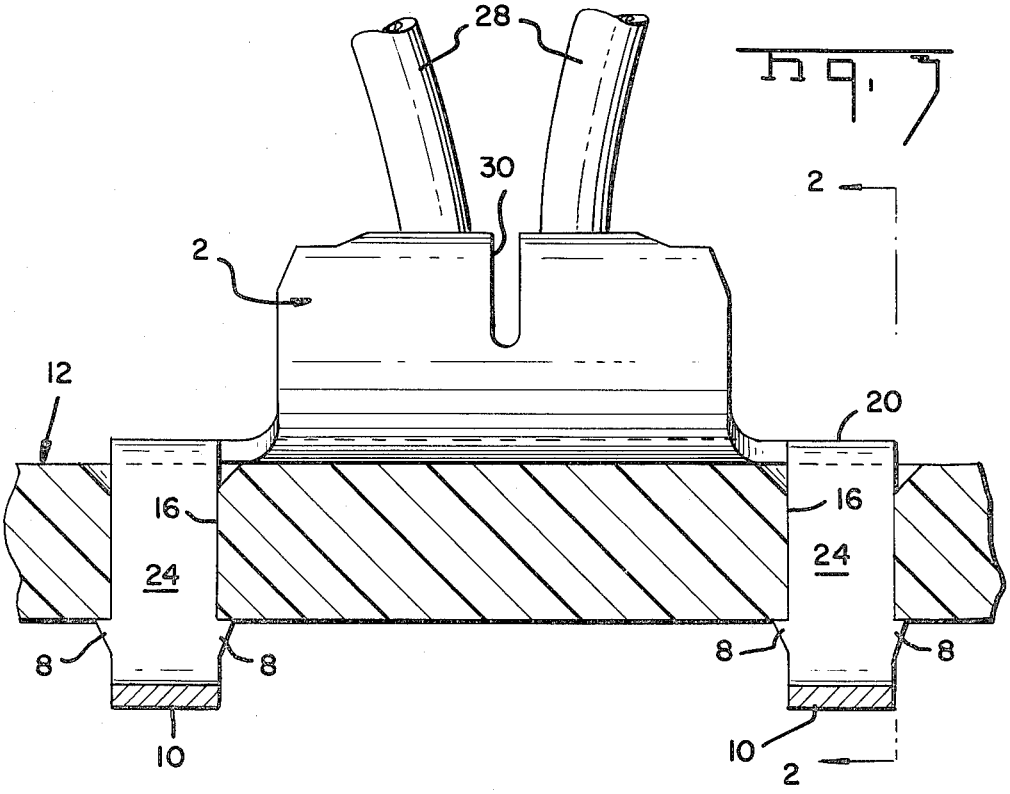

The embodiment of FIG. 1 shows the terminals 2 extending like rungs of a ladder between two parallel spaced carrier strips 4 and 6. Beginning with a flat strip, the terminals 2 are stamped and rolled into barrel shapes as shown. The strips 4 and 6 are stamped with wedge shaped projections 8, and are then doubled back on themselves to form bight portions 10. The terminals 2 are brought closer together upon forming bight portions 10, for dense spacing when mounted on a circuit board 12. One or a group of terminals 2 may be separated from the carrier strips 4 and 6 by severing respective bight portions 10, leaving partial bight portions 14. Each bight portion 10 has a pair of opposite aligned projections 8, on either side thereof, so that a partial bight portion has one pair of the projections 8. The board 12 includes mounting apertures 16 into which the bight portions 10 or 14 are plugged. As shown in FIGS. 2 and 3, the projections 8 lock against an opposite surface 18 of the board 12, holding portions 20 of the carrier strip against the surface 22 of the board 12. Leg portions 24 of the strip on either side of each bight 10 are resiliently deflectable toward each other by the impinging sides of the respective apertures 16. The partial bight portions 14 press their one leg portions 24 resiliently against the aperture sides. The projections 8 provide locking to prevent withdrawal from the respective apertures 16. Each terminal 2 includes a wire terminating slot 26. The sides of each slot are sharpened, resilient jaws which slice through insulation and grip opposite side of the conductor of an insulated wire 28 inserted laterally of its length along the slot. FIG. 3 more particularly shows a transverse slot 30 bifurcating the slot 26 to form tandem sets of jaws, so that each set of jaws will engage an insulated wire 28 therebetween.

Figure 4:
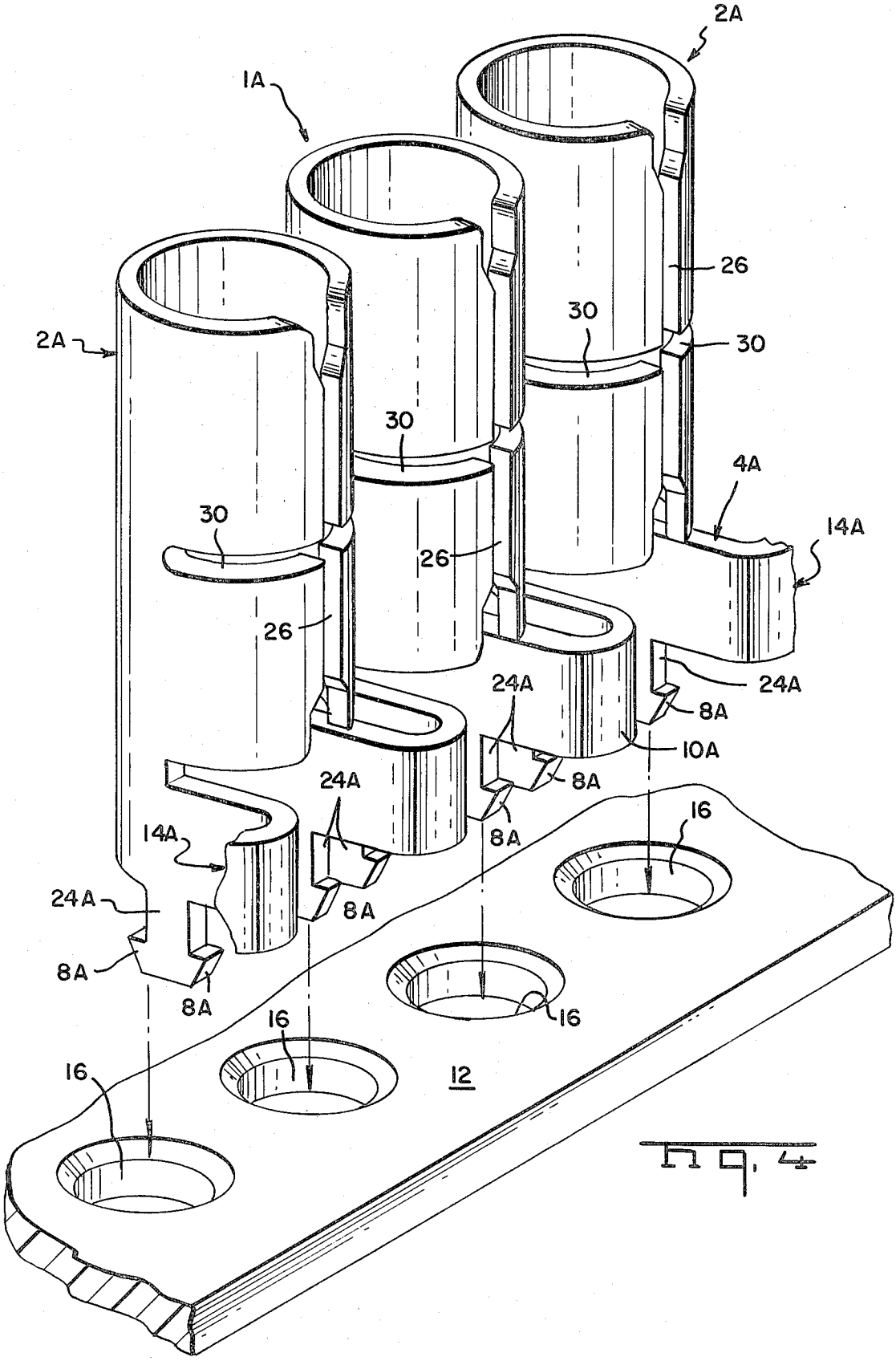
FIG. 4 is a fragmentary perspective with parts exploded of an alternative embodiment.

FIG. 4 shows another embodiment 1A of the invention wherein the terminals 2 are integral along one carrier strip 4A doubled back on itself to form bights 10A formed with leg portions 24A, with opposite projections 8A on each leg portion 24A. The leg portions 24A in this embodiment extend transversely of their respective bights 14A. Yet leg portions 24A remain on either side of their respective bights and retain their resilient properties, similar to the leg portions 24. One or a group of terminals are separated from the remainder of the carrier strip 4A by severing through respective bight portions 10A, leaving partial bight portions 14A each with a leg 24A and a pair of projections 8A. The leg portions 24A are mounted in apertures 16 of the board 12 with the bight portions 10A and 14A against one surface of the board, and with the projections locked against an opposite surface of the board 12.

Although preferred embodiments are described and illustrated in detail, other embodiments and modifications of the invention are intended to be covered by the spirit and scope of the present invention.

What is claimed is:

1. A plurality of electrical terminals for connection to a printed circuit board integrally joined together in a serial array by a carrier strip provided with a series of resilient bight portions extending between respective adjacent terminals with the axes of the bight portions extending transversely of a longitudinal axis of the strip, each bight portion having been formed by bending the strip back on itself and each bight portion having a projecting leg portion by which said terminals are mounted.

2. The improvement as recited in claim 1, wherein each bight portion interconnecting adjacent said terminals has a pair of said leg portions projecting therefrom.

3. The improvememnt as recited in claim 1, wherein, each said leg portion includes locking means for locking said leg in a mounting aperture.

* * * * *